United States Patent [19]

Allen

[11] 4,036,488

[45] July 19, 1977

[54] CHANNEL RECEPTACLE TRAY FOR FINISHED PHOTOCOPIES

[76] Inventor: Charles B. Allen, 9446 214th Place, Queens Village, N.Y. 11429

[21] Appl. No.: 702,248

[22] Filed: July 2, 1976

[51] Int. Cl.[2] ..... B65H 29/00

[52] U.S. Cl. ..... 271/186; 271/DIG. 9

[58] Field of Search ..... 271/65, 185, 186, DIG. 9

[56] References Cited

U.S. PATENT DOCUMENTS

| | | | |
|---|---|---|---|
| 302,918 | 8/1884 | Layman | 271/186 |
| 1,836,856 | 12/1931 | Lloyd | 271/186 |
| 2,868,115 | 1/1959 | Gollwitzer | 271/65 X |
| 3,851,872 | 12/1974 | Gerbasi | 271/65 X |
| 3,966,194 | 6/1976 | Abbe | 271/186 |

*Primary Examiner*—Richard A. Schacher
*Attorney, Agent, or Firm*—Allison C. Collard

[57] ABSTRACT

A receptacle for photocopy machines and the like consisting of a C-shaped chamber wherein the top portion has a substantially horizontal section which receives the copies as they are ejected from the photocopy machine. A curved portion which is integrally formed with horizontal portions, inverts the copies 180° so that they come to rest in a tray formed in the third portion of the receptacle. The copies are thus arranged in the same order in which they are reproduced. An opening is formed along the third horizontal portion to allow removal of the copy.

4 Claims, 3 Drawing Figures

CHANNEL RECEPTACLE TRAY FOR FINISHED PHOTOCOPIES

This invention relates to an improved receptacle tray for photocopy machines.

More specifically, this invention relates to a receptacle tray capable of rearranging the output copies of a photocopy machine in the same sequence corresponding to the order in which they were copied.

In conventional photocopy machines, such as Xerox machines, the receptacle tray generally receives copies face up in the order in they are reproduced. Thus, where a multi-page manuscript is reproduced, the last page of the manuscript is face up on top of all the succeeding pages. The manuscript copy thus has to be rearranged to put it into the proper numerical sequence before it can be stapled or bound.

Accordingly, the present invention provides a receptacle tray consisting of a U-shaped channel which is capable of inverting the finished photocopy before it is received and stacked. Thus, when a manuscript has been completely copied, the copies are in the same numerical order and are already collated for stapling or binding. The invention is of simple construction and readily adaptable for attachment to conventional photocopy machines such as a Xerox machine. Moreover, the receptacle has an opening along one side for removing the finished stack of copies after the copy of the manuscript has been completed.

It is therefore an object according to the present invention to provide an improved paper receptacle for photocopy machines which automatically arranges the finished copies in the same sequence in which they are made.

It is another object according to the present invention to provide a photocopy receptacle which is simple in design, easy to construct and reliable in operation.

Other objects and features of the present invention will become apparent from the following detailed description taken in consideration with the accompanying drawing which discloses the embodiments of the invention. It is to be understood, however, that the drawing is designed for the purpose of illustration only and not as a definition of the limits of the invention.

In the drawing, wherein similar reference characters denote similar elements throughout the several views.

Figure 1:
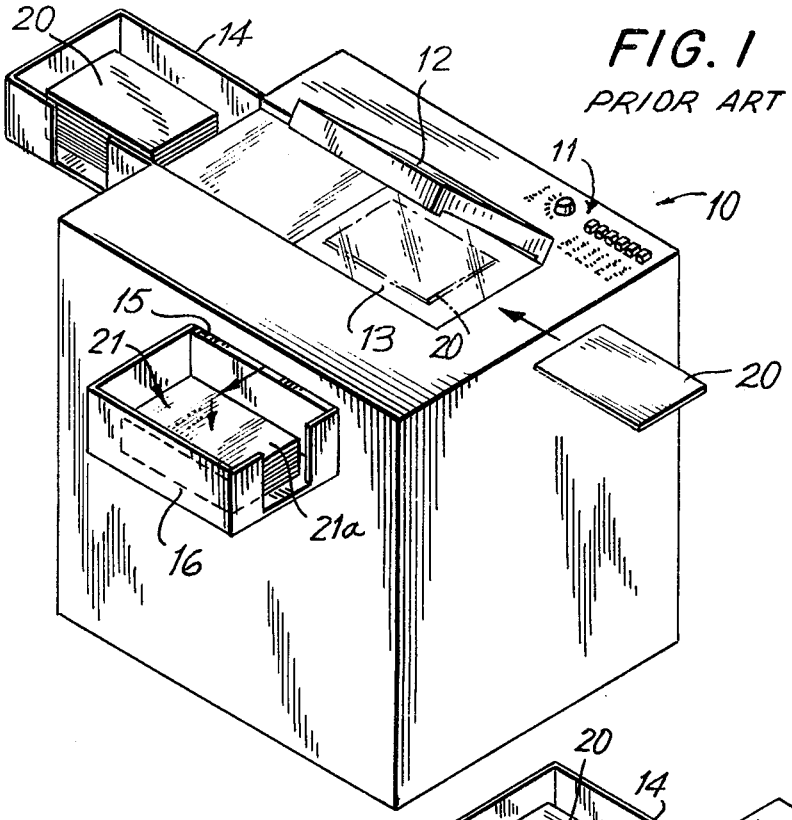
FIG. 1 PRIOR ART
FIG. 1 shows a prior art photocopy machine with a conventional receptacle tray as is well known in the art.
Figure 2:
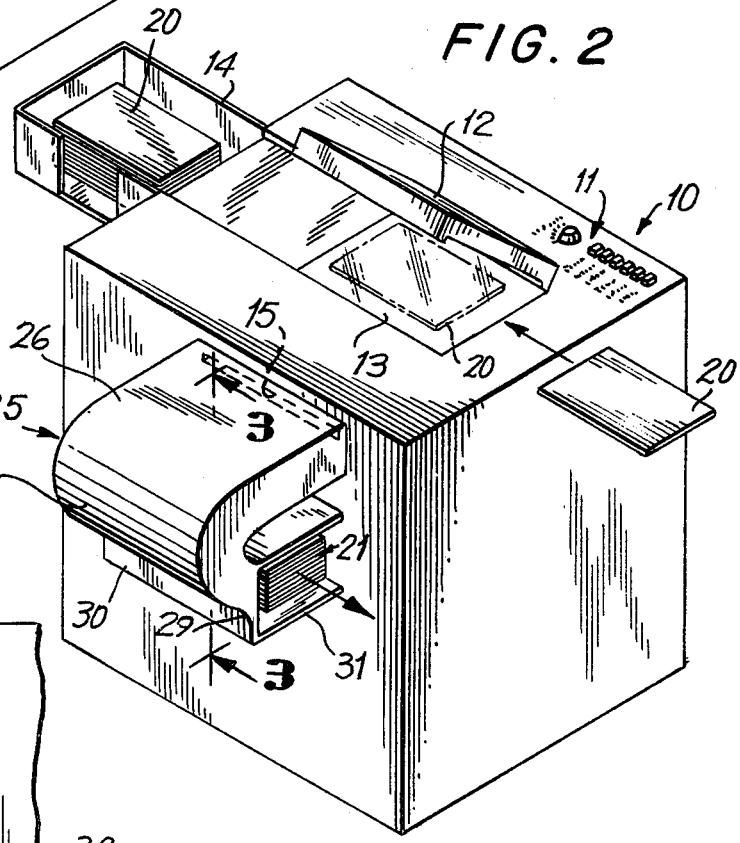
FIG. 2 shows a photocopy machine utilizing the receptacle tray of the present invention.
Figure 3:
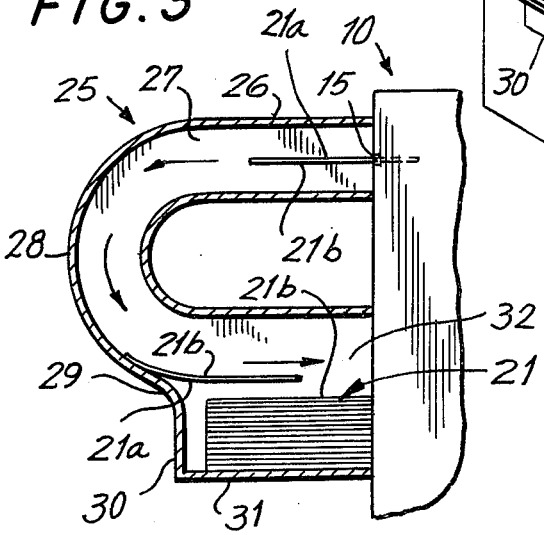
FIG. 3 is a cross sectional view taken along section 3—3 of FIG. 2.

Referring to FIGS. 1–3 there is shown a conventional photocopy machine 10 with a control panel 11 and a cover 12 which covers an optical glass 13 onto which paper copies 20 are provided. A tray 14 is located adjacent to glass 13 contains additional copies for reproduction. Along one side of photocopy machine 10 is an outlet opening 15 for which the finished photocopies 21 are discharged. In a conventional device they are generally received in a flat open tray 16 and collect with printed side **21*a*** face up.

FIGS. 2 and 3 show the photocopy machine 10 with the improved copy receptacle 25 coupled over output opening 15.

In the construction of receptacle, a first horizontal section 26 is provided which has a length approximately equal to the width of the copies being reproduced. The second or curved portion which is integrally formed with the first horizontal portion bends through an angle of approximately 180° to deposit a copy in a third horizontal section which is parallel to the first section. The lower wall of the third section forms a smooth curve 29 to the collection tray of the receptacle, consisting of wall 30 and floor 31 which is of a length sufficient to receive copies 21 as they are produced. Thus, as a copy 21 with its printed side **21*a* face up emerges from opening 15, it enters into an opening 27 between the walls 26, 28 and 29 of the receptacle. Copy 21 continues around the C-shaped channel as shown by the arrows and by the force of gravity its top surface 21*a* has been inverted so that its reverse side 21*b* is facing upwardly. At the bottom of receptacle 25 curved bottom wall 29 causes the moving copies to "flair-out" as they reach the collection tray. Above the bottom tray is a sufficient opening 32** to permit a number of copies to collect. At least one side of the receptacle tray is open as shown in FIG. 2 to permit the removal of the finished copies. It is obvious that since the copies are now inverted, they are in the same sequence as the original manuscript from which they were made. This saves considerable time, particularly for large manuscripts in collating and avoiding possible error in pages being misplaced within the copied document.

While only a single embodiment of the present invention has been shown and described, it will be obvious that many changes and modifications may be made thereunto without departing from the spirit and scope of the invention.

What is claimed is:

1. A receptacle device for attachment to the copy output opening of a photocopy machine comprising:

a gravity chute comprising a C-shaped channel having an open upper and a lower end, the upper end of which covers the output opening of the photocopy machine for receiving the finished photocopies, said channel being dimensioned and configured to permit relatively free and uninhibited sliding of the photocopies therethrough, and including a first horizontal section having a length approximately equal to the length of the copies to be reproduced, a second curved section integrally formed with said first horizontal section, said second curved section bending approximately 180°, and a third section substantially parallel with said first section and integrally formed at the bottom portion of said curved section, and a receiving tray formed adjacent the opposite lower end of said C-shaped channel and adjacent to the bottom leg thereof for collecting the finished copies so that when the copies are projected into the top leg, solely under the force of gravity, they traverse the C-shaped channel so that their top surface becomes inverted and comes to rest in the collection tray formed in the bottom of said channel.

2. The device as recited in claim 1 wherein said third section of said channel defines said collection tray.

3. The device as recited in claim 2 wherein the outside wall of said curved section is forms a smooth curve with the collection tray.

4. The device as recited in claim 3 wherein said lower horizontal portion includes an opening along at least one side to permit removal of the finished copies.

* * * * *